US005863210A

United States Patent [19]

Reisinger

[11] Patent Number: 5,863,210

[45] Date of Patent: Jan. 26, 1999

[54] MOUNTING BRACKET FOR MODULAR JACK

[75] Inventor: Jason M'Cheyne Reisinger, Mountain View, Calif.

[73] Assignee: The Whitaker Corporation, Wilmington, Del.

[21] Appl. No.: 690,686

[22] Filed: Jul. 31, 1996

[51] Int. Cl.[6] ..... H01R 13/73

[52] U.S. Cl. ..... 439/41; 439/571

[58] Field of Search ..... 439/569–572, 439/607, 83, 41

[56] References Cited

U.S. PATENT DOCUMENTS

| | | | |
|---|---|---|---|
| 4,629,278 | 12/1986 | Norton et al. | 339/134 |
| 4,969,829 | 11/1990 | Sato | 439/83 |
| 5,044,988 | 9/1991 | Hirayama | 439/571 |
| 5,085,590 | 2/1992 | Galloway | 439/95 |
| 5,282,751 | 2/1994 | Lwee | 439/77 |
| 5,591,050 | 1/1997 | Sueoka | 439/607 |
| 5,622,519 | 4/1997 | Bixler et al. | 439/570 |

FOREIGN PATENT DOCUMENTS

| | | |
|---|---|---|
| 63-45988 | 3/1988 | Japan . |
| 3-266384 | 11/1991 | Japan . |
| 7-167884 | 7/1995 | Japan . |
| 7-37268 | 8/1995 | Japan . |

OTHER PUBLICATIONS

*AMP Catalog 82066*, "Modular Interconnection System", pp. 1–3, 10; (Aug. 1992); AMP Incorporated, Harrisburg, PA.

*AMP Brochure*, "Surface Mounting", pp. 2–5, 21, 22; (Oct. 1990); AMP Incorporated, Harrisburg, PA.

*Primary Examiner*—Gary F. Paumen
*Attorney, Agent, or Firm*—Anton P. Ness

[57] ABSTRACT

A connector housing 10 is mountable to a circuit board along a board-mounting face 18, and a mounting bracket 40 is secured around side walls 12 and upper wall 14 with mounting feet 46 extending outwardly from the housing parallel to board-mounting face 18 for being soldered to the circuit board, eliminating the need for mounting holes through the circuit board. Projections 28 of side walls 12 extend outwardly through slots 48 of vertical leg sections 44 of bracket 40 and lances 52 extend from slot edges 50 bite into projections 28 to secure the bracket assuredly to housing 10.

2 Claims, 2 Drawing Sheets

MOUNTING BRACKET FOR MODULAR JACK

FIELD OF THE INVENTION

This relates to the field of electrical connectors and more particularly to connectors that are mountable to circuit boards.

BACKGROUND OF THE INVENTION

Electrical connectors may be mountable to circuit boards by means of separate fasteners extending through apertured mounting flanges of the connector aligned with mounting holes of the circuit board, or the connector may provide mounting projections that are either integral with the housing or are separate board-lock members affixed to the housing prior to board mounting.

Conventionally, such fastening systems include a projection that extends through mounting holes of the board. In certain electrical connectors, the electrical contacts include solder tails having ends that are horizontal and thus adapted to be soldered to circuit pads on the surface of the circuit board in a surface mount technique, instead of comprising vertical legs that are inserted through corresponding through-holes of the board, but mounting holes of the board are still utilized for mechanically fastening the connector to the board.

It is desired to provide a connector that is mountable to a circuit board without requiring holes through the board.

SUMMARY OF THE INVENTION

The present invention provides a bracket member that is secured to the connector housing and concludes at opposed ends in mounting tabs extending horizontally outwardly from the housing at the board-mounting face, such that the mounting tabs are solderable to pads of the circuit board. The bracket includes profiled slots along vertical housing-adjacent legs such that projections of the housing extend therethrough, and preferably the edges of the slots include lances that are deflected by the projections upon assembly to abut the projections at an angle for free ends to bite into the projections for holding the bracket to the housing.

An embodiment of the invention will now be described by way of example with reference to the accompanying drawings.

DETAILED DESCRIPTION

Figure 1:
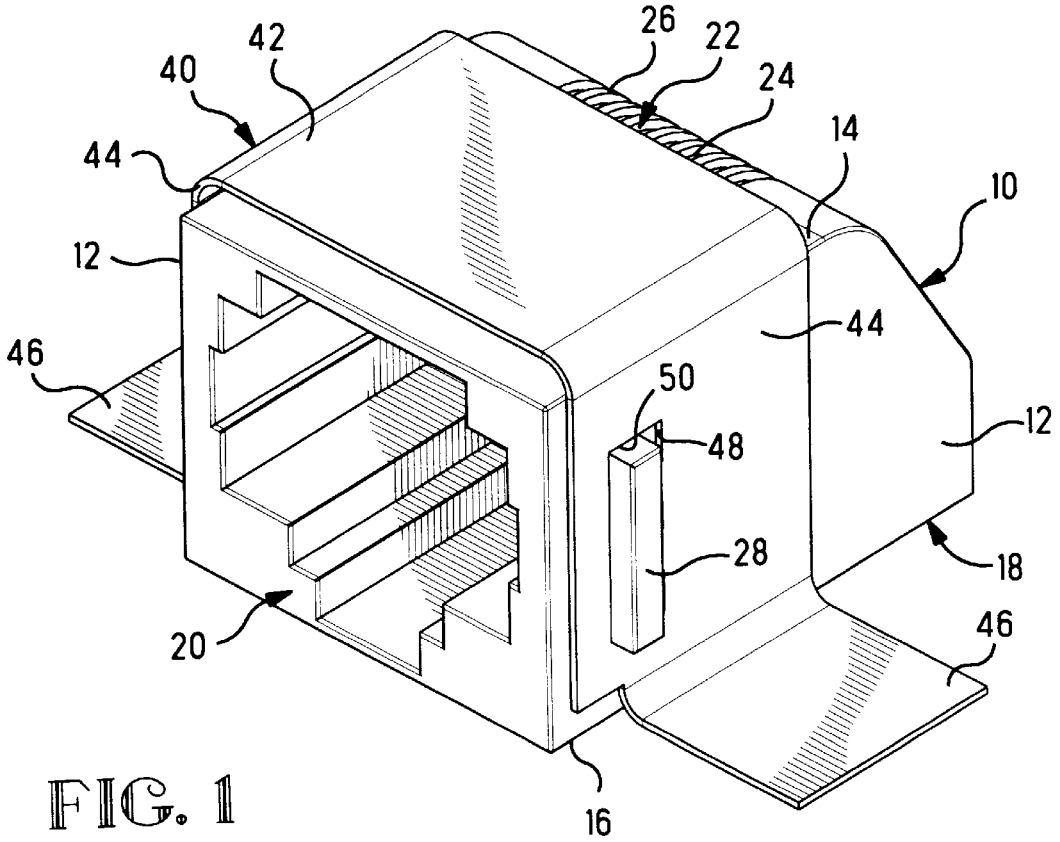
FIG. 1 is an isometric view of the assembly of a housing with the mounting bracket of the present invention.
Figure 2:
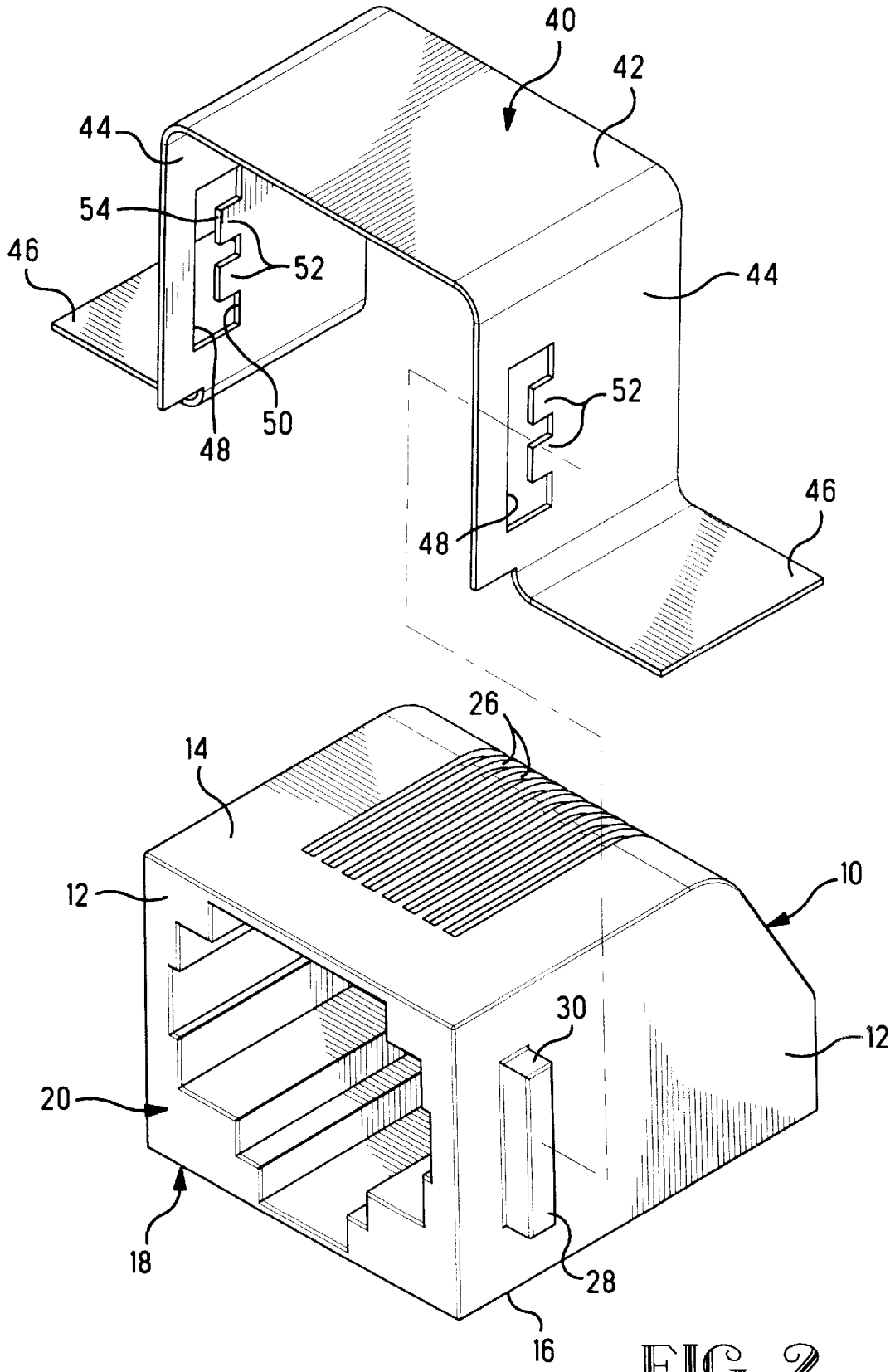
FIG. 2 is an isometric view of the housing of FIG. 1 with the mounting bracket exploded therefrom.

Housing 10 includes opposed side walls 12, upper wall 14 and lower wall 16 defining a board-mounting face 18, and extends rearwardly from mating face 20 to a rearward face. Contacts 22 of the connector are retained in the housing and are of the type having solder tails (not shown) projecting from lower wall 16 remote from mating face 20 of the housing and extending horizontally along board-mounting face 18 for surface mounting to circuit pads of a circuit board (not shown). In the connector shown, body sections 24 of the contacts extend in channels 26 along the outer surface of upper wall 14 in a simplified assembly process rather than being embedded in the walls of the housing or extending through passageways thereof. Projections 28 extend outwardly from side walls 12 such as could be used to assist in retaining and positioning a shield member around and onto the housing by extending outwardly through slots thereof, and also commonly serve as panel stops. Such a connector is commercially available from AMP Incorporated, Harrisburg, Pa. as Part No. 558178-1, except that mounting pegs for insertion into mounting holes of a circuit board are removed for use with the mounting bracket of the present invention, and no shield is utilized in the present example of FIGS. 1 to 3.

Mounting bracket 40 includes a central section 42 from which leg sections 44 depend and extend to mounting sections 46 extending.horizontally outwardly. Slots 48 are defined in leg sections 44 and are associated with projections 28 of housing side walls 12. Along one edge 50 of each slot 48 preferably is at least one lance 52 extending into the slot.

Figure 3:
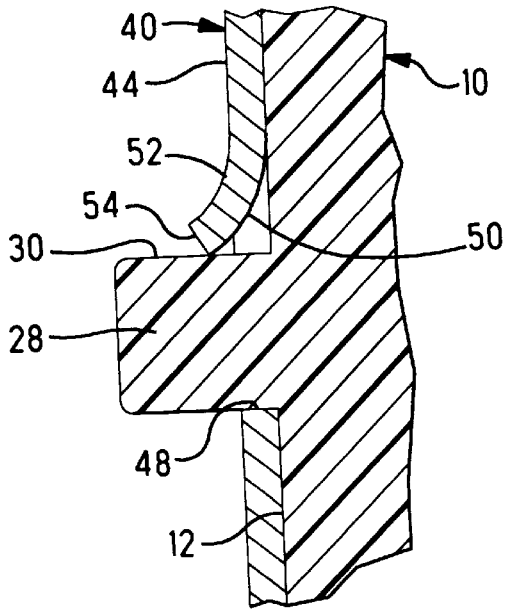
FIG. 3 is an enlarged part section view of the bracket/housing securing system.

In FIG. 3 is illustrated a lance 52 bent outwardly along a side surface 30 of projection 28 with a leading edge 54 biting into side surface 30, thus securing bracket 40 to housing 10. Mounting bracket 40 may be formed for example of brass or phosphor-bronze metal, preferably with tin/lead plating over nickel underplating of the bottom surfaces of the mounting feet for enhanced solderability. Central section 42 of bracket 40 also serves to cover grooves 26 and provide a continuous imperforate flat surface enabling pickup by vacuum apparatus during automatic mounting of the connector to a circuit board.

What is claimed is:

1. An electrical connector assembly comprising:

a housing including a mating face and a board-mounting face, a top wall and opposed side walls extending from said board-mounting face and having projections extending outwardly therefrom, and an integral mounting bracket having a central section extending over a substantial portion of said housing top wall to define a continuous top surface for a vacuum pickup, and vertical leg sections depending integrally from said central section adjacent and along respective said housing side walls and extending to feet sections parallel to said board-mounting face, said bracket including slots in said vertical leg sections through which said projections of said housing side walls extend outwardly for retaining said bracket to said housing, whereby said mounting bracket feet are solderable to surfaces of a circuit board to which the housing is to be mounted, and the continuous top surface enables vacuum pickup and placement of the connector after assembly.

2. The connector assembly as set forth in claim 1 wherein at least one lance of said bracket extends from an edge of said slot into said slot to be engaged and deflected by a surface of a respective said projection and to bite thereinto for enhancement of the securing of said bracket to said housing.

* * * * *